United States Patent [19]

Dobler

[11] 4,099,490

[45] Jul. 11, 1978

[54] METHOD FOR PRODUCING A HOUSING CASING FOR A ROTARY PISTON INTERNAL COMBUSTION ENGINE

[75] Inventor: Helmut Dobler, Esslingen, Fed. Rep. of Germany

[73] Assignee: Daimler-Benz Aktiengesellschaft, Fed. Rep. of Germany

[21] Appl. No.: 523,046

[22] Filed: Nov. 12, 1974

Related U.S. Application Data

[62] Division of Ser. No. 328,534, Feb. 1, 1973, Pat. No. 3,892,082.

[30] Foreign Application Priority Data

Feb. 1, 1972 [DE] Fed. Rep. of Germany ..... 2204560

[51] Int. Cl.[2] ..... F02B 53/00

[52] U.S. Cl. ..... 123/210; 418/178

[58] Field of Search ..... 418/178, 61 A; 123/8.09, 193 H, 193 C, 169 R, 8.01, 193 CH, 193 CP; 29/156.4, 527.1, 527.2, 156.4 WL

[56] References Cited

U.S. PATENT DOCUMENTS

| | | | |
|---|---|---|---|
| 2,436,043 | 2/1948 | Herreshoff et al. | 29/156.4 X |
| 3,506,383 | 4/1970 | Ewalt | 418/178 |
| 3,512,907 | 5/1970 | Belzner | 418/179 X |
| 3,680,990 | 8/1972 | Pettibone et al. | 418/178 |
| 3,705,818 | 12/1972 | Grosseau | 418/178 X |
| 3,851,627 | 12/1974 | Terazawa | 123/8.09 |
| 3,908,610 | 9/1975 | Stahle | 123/8.01 |

FOREIGN PATENT DOCUMENTS

| | | | |
|---|---|---|---|
| 1,006,814 | 10/1965 | United Kingdom | 29/156.4 |

*Primary Examiner*—Irwin C. Cohen
*Attorney, Agent, or Firm*—Craig & Antonelli

[57] ABSTRACT

A method for manufacturing a housing casing for a rotary piston internal combustion engine, especially of trochoidal construction, as well as the housing casing made according to this method, whereby the housing casing consists of light metal whose internal running surface for the piston consists of a coating of hard material; the method thereby involves leaving during the machining of the inner wall of the housing casing a material island of such light metal about the discharge opening of the already bored or still to be bored spark-plug-firing channel, whose height corresponds at least to the thickness of the coating to be subsequently provided along the inner contour of the housing casing in the finish-machined condition; as a result thereof the area of the discharge opening of the firing channel is constituted exclusively of such light metal.

9 Claims, 4 Drawing Figures

FIG. 3
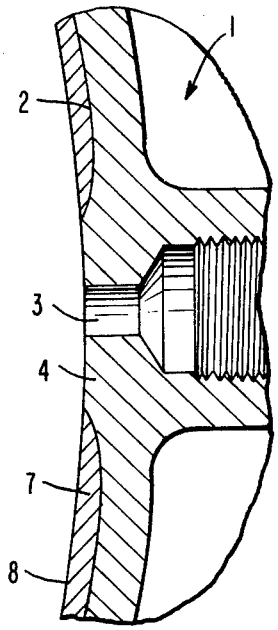
FIG. 1
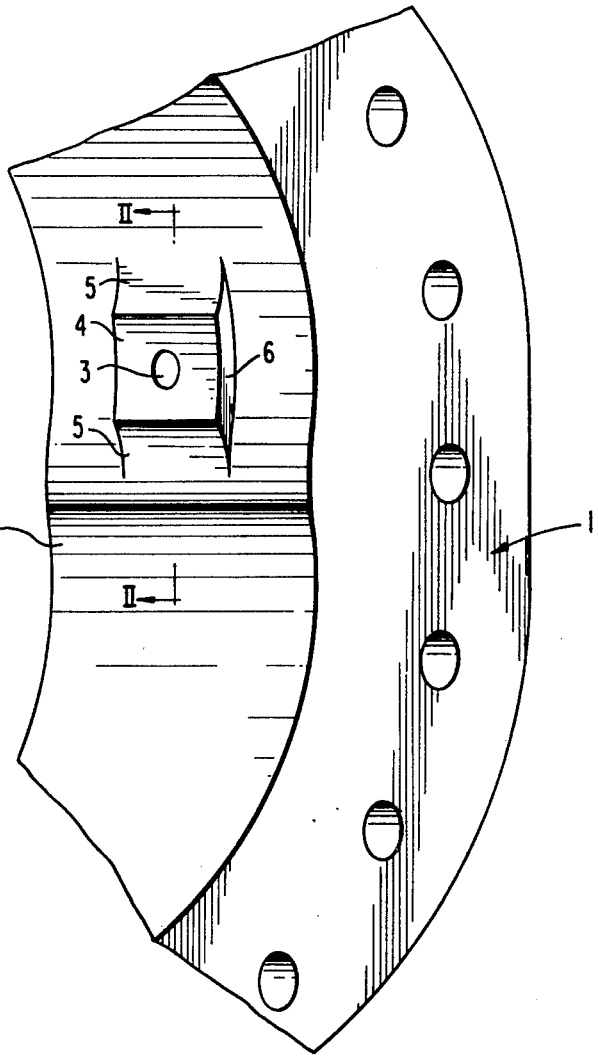
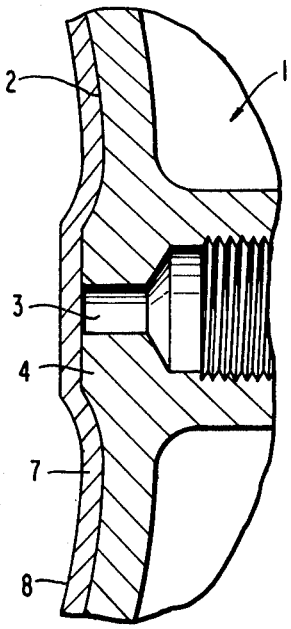
FIG. 2
FIG. 4
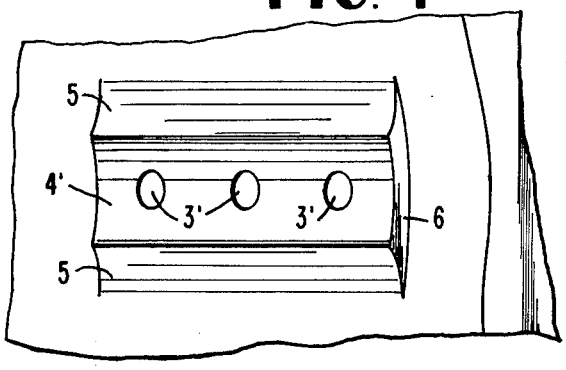

METHOD FOR PRODUCING A HOUSING CASING FOR A ROTARY PISTON INTERNAL COMBUSTION ENGINE

This is a division of application Ser. No. 328,534 filed Feb. 1, 1973, now Pat. No. 3,892,082.

The present invention relates to a method for the manufacture of a housing casing for a rotary piston internal combustion engine, especially for an internal combustion engine of trochoidal type of construction, which consists of light metal and in which the running surface for the piston, in which terminates a spark plug-firing channel, consists of a coating of a hard material.

With the rotary piston internal combustion engines having housing casings of the type described above, the high temperatures within the area of the spark-plug-firing channel at the discharge orifice or mouth of the spark-plug-firing channel become effective as high circumferential compressive stresses. Though the more expansible light metal is able to follow this pressure stress or compressive stress, the coating of hard metal is not able to do so. The disadvantageous consequence is that cracks form in the coating within the area of the mouth of the spark-plug-firing channel, which by reason of the good adherence of the coating on the light metal, continue up to into the latter. If these cracks reach cooling water spaces in the housing casing, then water penetrates into the working chambers of the internal combustion engine.

The present invention is concerned with the task to so construct a housing casing that the described disadvantages no longer can arise. The underlying problems are solved according to the present invention in that during the machining of the inner wall of the housing casing, a material island of the light metal material of the housing casing is left standing about the mouth of the already bored or yet to be bored spark-plug-firing channel, whose height corresponds at least to the thickness of the coating to be provided at the inner wall in the machined condition.

As a result of the measure according to the present invention, light metal is present in the running surface for the piston about the mouth of the spark-plug-firing channel so that no cracks can occur in the endangered area as occur with the use of materials of different thermal expansion.

In an advantageous construction of the present invention, the coating of the inner wall of the housing casing can be realized also over the material island and the portion of the coating lying on the material island can then be removed during the finish-machining of the running surface formed by the coating. These measures are recommended in particular when the coating is applied galvanically and a covering of the material island is either not possible or not appropriate.

The housing casing can be constructed in a simple manner such that the material island has a rectangular or square surface and includes four side walls of which two slope off continuously in the circumferential direction and of which the other two drop off steeply in the axial direction.

Accordingly, it is an object of the present invention to provide a method for manufacturing a housing casing for a rotary piston internal combustion engine and a housing casing made according to such method which avoid by simple means the aforementioned shortcomings and drawbacks encountered in the prior art.

Another object of the present invention resides in the method of manufacturing a housing casing for a rotary piston internal combustion engine and a housing casing made according to such method which minimizes the formation of cracks within the area of the orifice of the spark-plug-firing channel, thereby minimizing the danger of leakage of cooling water into the working chambers of the engine.

A further object of the present invention resides in a method for manufacturing a housing casing for a rotary piston internal combustion engine which is simple, permits the use of few, simple steps to achieve the finished product and involves practically no additional operating steps of any significance to achieve the final product.

Still another object of the present invention resides in a housing casing for a rotary piston internal combustion engine which excels by great resistance to the crack formation, especially within the area of the discharge end of the firing channel of the spark plug.

These and further objects, features and advantages of the present invention will become more apparent from the following description when taken in connection with the accompanying drawing which shows, for purposes of illustration only, two embodiments in accordance with the present invention, and wherein:

FIG. 1 is a partial perspective view of a housing casing consisting of light metal;

FIG. 2 is a cross-sectional view, on an enlarged scale, through the housing casing with an applied coating, taken along line II—II of FIG. 1;

FIG. 3 is a cross-sectional view, on an enlarged scale, through the housing casing illustrating the configuration of the running surface of the housing casing after a finish-machining operation; and FIG. 4 is a partial perspective view of a housing casing consisting of light metal having a common material island for accommodating several spark-plug firing channels.

Referring now to the drawing wherein like reference numerals are used throughout the two views to designate like parts, and more particularly to FIG. 1, the housing casing generally designated in this figure by reference numeral 1 for an otherwise conventional rotary piston internal combustion engine of trochoidal construction consists of light metal, for example, of aluminum and its inner wall 2 is machined according to a trochoidally shaped contour in order that a layer or coating of hard metal serving as running surface for the piston of the internal combustion engine, for example, a galvanically applied layer of a material containing essentially nickel, can be provided. In order to have only light metal and no hard metal present within the area about the discharge orifice or mouth of the already bored or possibly still to be bored spark plug-firing channel 3 after the attachment of the coating of hard metal, a material island 4 with rectangular or square surface has been left standing during the machining of the inner wall 2, whose height corresponds at least to the thickness of the coating to be applied. The side walls 5 of the material island 4 pass over into the inner wall 2 sloping off or dropping off continuously in the circumferential direction of the housing casing 1, i.e., by a smooth curvature whereas the side walls 6 drop off steeply in the axial direction (FIG. 1).

After the application of the coating 7 of hard metal, the arrangement results which can be seen from FIG. 2. The coating 7 of hard metal of any conventional, known type, covers both the inner wall 2 as also the material island 4. During the machining of the running surface 8 for the piston on the coating 7, the portion of the coating 7 covering the material island 4 and a portion of the material island 4 possibly projecting beyond the running surface 8 are removed so that after the finish-machining of the running surface 8, the latter consists of light metal about the discharge orifice of the spark-plug-firing channel 3 as shown in FIG. 3. The hard running-surface portions begin only at a certain distance from the discharge opening or mouth of the spark-plug-firing channel 3.

As shown in FIG. 4, with the arrangement of several spark-plug-firing channels 3' in one and the same engine, a common material island 4' can be provided for these several spark-plug-firing channels 3' or a separate material island may be provided for each spark-plug-firing channel.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. A housing casing for a rotary piston internal combustion engine which consists essentially of light metal and which includes a coating of hard material for a piston running surface with a spark-plug-firing channel means terminating in a discharge opening in said running surface, characterized in that the area about the discharge opening of the spark-plug-firing channel means is constituted by a material island of said light metal whose height corresponds to a thickness of the coating provided at an inner contour of the housing casing in a machined condition so that the coating of harder metal commences only at a distance from the spark-plug firing channel means.

2. A housing casing according to claim 1, characterized in that the material island has a substantially rectangular surface with lateral walls falling off continuously in a circumferential direction of the piston running surface and dropping off steeply in an axial direction of the spark-plug firing channel means.

3. A housing casing according to claim 2, characterized in that the internal combustion engine is of trochoidal construction.

4. A housing casing according to claim 1, characterized in that the material island is provided with lateral walls falling off continuously in a circumferential direction of the piston running surface and dropping off steeply in an axial direction of the spark-plug firing channel means.

5. A housing casing according to claim 1, characterized in that the material island has a substantially square surface.

6. A housing casing for a rotary internal combustion engine, the casing consisting essentially of a light metal and including a contoured piston running surface, a coating of hard material provided on said running surface, and at least one spark-plug firing channel provided in a wall of the housing casing and terminating in a discharge opening in said running surface, the improvement comprising: means provided at the discharge opening of the spark-plug firing channel for preventing the occurrence of thermal cracks at the discharge opening including a material island of the light metal of the housing casing.

7. A housing casing according to claim 6, wherein said material island includes an upper surface portion having a contour corresponding to the contour of the piston running surface, spaced side walls defining the width of said material island extending in the axial direction of the spark-plug firing channel, and further spaced walls extending in the circumferential direction of the piston running surface, said further walls sloping off from said upper surface portion of said material island in the circumferential direction of the piston running surface whereby the coating of hard material begins at a predetermined distance from the discharge opening of the spark-plug firing channel.

8. A housing according to claim 7, wherein several discharge openings are provided in said material island.

9. A peripheral housing shell, for use in a rotary internal combustion engine having a housing comprising a peripheral shell and a pair of end walls defining an engine cavity, and a rotor disposed in the engine cavity and having sealing means sweeping the inner surface of the peripheral shell in sealing relation therewith, wherein the improvement comprises:

a. the peripheral shell being formed of a lightweight basis metal with its inner surface coated with a layer of hard material forming the sealing surface swept by the rotor sealing means;

b. the peripheral shell having at least one spark plug recess therein and an ignition channel communicating between the spark plug recess and the engine cavity with its orifice at the sealing surface;

c. the basis metal of the shell having an island of the basis metal protruding from its inner surface through the hard coating layer and surrounding the orifice of the ignition channel, the surface of the island being flush with the sealing surface; and d. the island having a sloping side wall between its surface and the inner surface of the peripheral shell, the sloping side wall being covered by the hard coating material.

* * * * *